US010248038B1

(12) United States Patent
Qi et al.

(10) Patent No.: US 10,248,038 B1
(45) Date of Patent: Apr. 2, 2019

(54) GRAPHENE-CONTAINING TONERS AND RELATED METHODS

(71) Applicant: Xerox Corporation, Norwalk, CT (US)

(72) Inventors: Yu Qi, Penfield, NY (US); Shigeng Li, Penfield, NY (US); Chieh-Min Cheng, Rochester, NY (US); Richard P. N. Veregin, Mississauga (CA); Edward G. Zwartz, Mississauga (CA)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 15/877,622

(22) Filed: Jan. 23, 2018

(51) Int. Cl.
*G03G 9/087* (2006.01)
*G03G 9/093* (2006.01)

(52) U.S. Cl.
CPC ..... *G03G 9/09385* (2013.01); *G03G 9/09328* (2013.01); *G03G 9/09371* (2013.01); *G03G 9/09392* (2013.01)

(58) Field of Classification Search
CPC ..... G03G 9/0935; G03G 9/09371; G03G 9/09385
See application file for complete search history.

(56) References Cited

U.S. PATENT DOCUMENTS

| | | | |
|---|---|---|---|
| 8,718,528 | B2 | 5/2014 | Zhang et al. |
| 9,176,405 | B2 | 11/2015 | Nair et al. |
| 9,394,421 | B2 | 7/2016 | Zhang et al. |
| 9,458,325 | B2 | 10/2016 | Zhang et al. |
| 9,529,312 | B2 | 12/2016 | Qi et al. |
| 9,658,545 | B2 | 5/2017 | Nair et al. |
| 9,682,166 | B2 | 6/2017 | Watanabe |
| 2016/0326337 | A1 | 11/2016 | Farrugia et al. |
| 2016/0327879 | A1* | 11/2016 | Farrugia ..... G03G 9/0825 |

* cited by examiner

*Primary Examiner* — Peter L Vajda
(74) *Attorney, Agent, or Firm* — Bell & Manning, LLC

(57) ABSTRACT

Graphene-containing toners are provided. In an embodiment, a graphene-containing toner comprises a core comprising graphene, a crystalline polyester resin, and an amorphous polyester resin, the toner further comprising a shell over the core. Methods of making and using the toners are also provided.

20 Claims, 1 Drawing Sheet

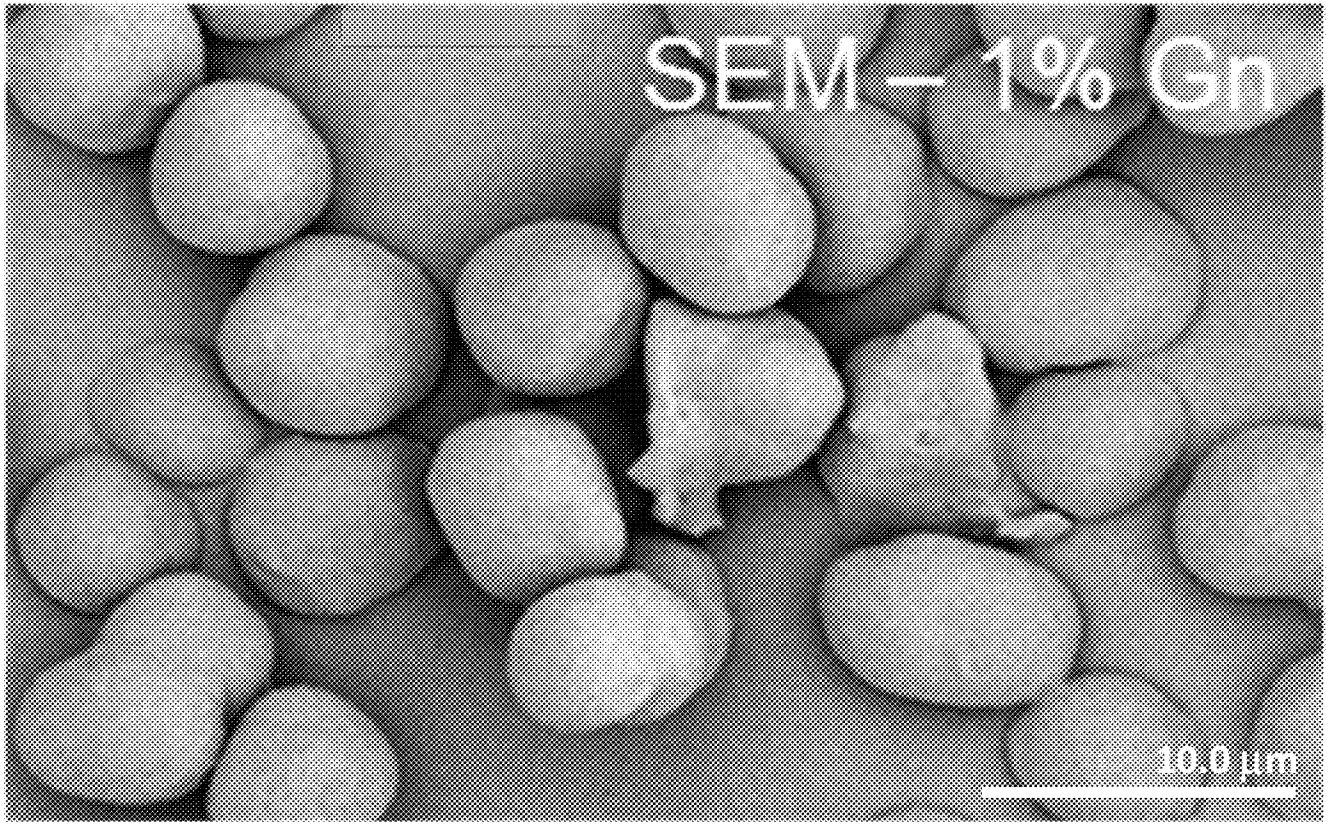
SEM – 1% Gn
10.0 µm

GRAPHENE-CONTAINING TONERS AND RELATED METHODS

BACKGROUND

Conventional printing systems for toner applications consist of four stations comprising cyan, magenta, yellow, and black (CMYK) toner stations. Printing systems have been developed which include the concept of a fifth xerographic station to enable gamut extension via the addition of a fifth color or specialty colors. At any given time, the machine can run CMYK toners plus a fifth color in the fifth station. It is desirable to develop a metallic ink formulation to also be run in the fifth station. Toners capable of making metallic hues, especially silver or golden, are particularly desired for their esthetic appeal, for example, on wedding cards, invitations, advertising, etc. Metallic hues cannot be obtained from CMYK primary color mixtures. However, metallic effects have been achieved by using aluminum flake pigments.

SUMMARY

The present disclosure provides illustrative examples of graphene-containing toners, methods of making the toners and methods of using the toners.

In one aspect, graphene-containing toners are provided. In embodiments, a graphene-containing toner comprises a core comprising graphene, a crystalline polyester resin, and an amorphous polyester resin, the toner further comprising a shell over the core. In embodiments, a graphene-containing toner comprises a core comprising graphene nanoplatelets, a crystalline polyester resin, and an amorphous polyester resin, the toner further comprising a shell over the core, wherein the graphene nanoplatelets are homogeneously distributed within the core and completely encapsulated within the toner, and further wherein the graphene is present in the toner at an amount of no more than about 10% by weight.

In another aspect, methods of making a graphene-containing toner are provided. In embodiments, a method of making a graphene-containing toner comprises forming a mixture comprising a graphene dispersion comprising graphene, a first emulsion comprising a crystalline polyester resin, a second emulsion comprising an amorphous polyester resin, and optionally, a wax dispersion; aggregating the mixture to form particles of a predetermined size; forming a shell over the particles of the predetermined size to form core-shell particles; and coalescing the core-shell particles to form the graphene-containing toner.

In another aspect, methods of using a graphene-containing toner are provided. In embodiments, a method of using a graphene-containing toner comprises forming an image comprising a graphene-containing toner using a xerographic printer, the graphene-containing toner comprising a core comprising graphene, a crystalline polyester resin, and an amorphous polyester resin, the toner further comprising a shell over the core; transferring the image comprising the graphene-containing toner to an image receiving medium; and fusing the graphene-containing toner to the image receiving medium.

BRIEF DESCRIPTION OF THE DRAWINGS

Illustrative examples of the present disclosure are described with reference to the accompanying drawings.

FIG. 1 shows a scanning electron microscope (SEM) image of an illustrative graphene-containing toner.

DETAILED DESCRIPTION

The present disclosure provides illustrative examples of graphene-containing toners, methods of making the toners and methods of using the toners. The graphene-containing toners comprise a core comprising graphene dispersed within one or more polymeric resins, and a shell over the core, the shell also comprising one or more polymeric resins which may or may not be the same as the resin(s) within the core. Graphene is particularly challenging to incorporate into a toner. This is due, at least in part, to the conductive properties of graphene, which can interfere with attaining a triboelectric charge sufficient to allow the toner to be used in a xerographic process. However, at least some embodiments of the present toners include a sufficient amount of graphene to provide one or more advantageous properties, e.g., suppression of the minimum fix temperature (MFT), while also maintaining the kind of charging and blocking characteristics which enable use in xerographic printing. Since graphene exhibits at least some metallic features, at least some embodiments of the present toners may be used as an alternative to aluminum flake-based toners, thereby eliminating the health and safety concerns posed by aluminum flake compositions.

Graphene

The present toners comprise graphene. In the present specification, the term "graphene" can encompass a single layer of graphene as well as multiple layers of graphene, e.g., a plurality of self-assembled single layers of graphene. Different morphologies of graphene may be used, the graphene may be in the form of sheets or non-planar particles. In embodiments, the graphene is in the form of graphene nanoplatelets. Graphene nanoplatelets are composed of several single layers of graphene. Graphene nanoplatelets are high aspect ratio nanoparticles which are very thin but have large diameters. The size and morphology of graphene nanoplatelets provides this type of graphene with useful mechanical properties (e.g., stiffness and strength) while their pure graphitic composition makes them excellent electrical and thermal conductors. In embodiments, graphene nanoplatelets are used which have an average thickness in the range of from about 6 nm to about 8 nm and an average diameter in the range of from about 0.5 μm to about 100 μm. In embodiments, graphene nanoplatelets are used which have an average thickness in the range of from about 6 nm to about 8 nm and an average diameter in the range of from about 0.5 μm to about 10 μm. In embodiments, graphene nanoplatelets are used which have an average thickness in the range of from about 6 nm to about 8 nm and an average diameter in the range of from about 0.5 μm to about 5 μm. In such an embodiment, the graphene nanoplatelets may have an average surface area in the range of from about 120 $m^2/g$ to about 150 $m^2/g$. By "average" it is meant an average value over a representative population of graphene nanoplatelets. Commercially available graphene nanoplatelets may be used, e.g., such as those from XG Sciences and Strem Chemicals Inc.

As noted above, the graphene is present within the core of the present toners. In embodiments, the graphene is completely encapsulated within the particles of the toner (i.e., the core-shell particles) such that no graphene is present at or on the surface of the particles. In embodiments, no graphene is present within the shell of the toner. In these cases, by "no" it is meant "substantially no" such that no graphene is present, or the amount is too small to have any material effect on the properties of the toner (described further below). Encapsulation may be confirmed using transmission electron microscopy (TEM) as described in the Example, below. The graphene may be homogenously distributed throughout the resin matrix of the core of the particles of the toner. By "homogeneous" it is meant "substantially homogeneous" with a meaning analogous to that described above with respect to "no." The distribution may also be confirmed using TEM.

The amount of graphene in the present toners may vary, depending upon the application. In embodiments, the graphene is present at an amount in the range of from about 0.1% by weight to about 15% by weight, from about 0.2% by weight to about 10% by weight, from about 5% to about 8% by weight, or from about 0.1% by weight to about 5% by weight, all as compared to the weight of the toner.

Resins

The present toners may comprise a variety of resins, which provides a polymeric matrix to contain the graphene described above. The present toners may comprise more than one different type of resin. The resin may be an amorphous resin, a crystalline resin, or a mixture of crystalline and amorphous resins. The resin may be a polyester resin, including an amorphous polyester resin, a crystalline polyester resin, or a mixture of crystalline polyester and amorphous polyester resins.

Crystalline Resin

The resin may be a crystalline polyester resin formed by reacting a diol with a diacid in the presence of an optional catalyst. For forming a crystalline polyester, suitable organic diols include aliphatic diols with from about 2 to about 36 carbon atoms, such as 1,2-ethanediol, 1,3-propanediol, 1,4-butanediol, 1,5-pentanediol, 2,2-dimethylpropane-1,3-diol, 1,6-hexanediol, 1,7-heptanediol, 1,8-octanediol, 1,9-nonanediol, 1,10-decanediol, 1,12-dodecanediol, combinations thereof, and the like including their structural isomers. The aliphatic diol may be, for example, selected in an amount of from about 40 to about 60 mole percent of the resin, from about 42 to about 55 mole percent of the resin, or from about 45 to about 53 mole percent of the resin, and a second diol may be selected in an amount of from about 0 to about 10 mole percent of the resin or from about 1 to about 4 mole percent of the resin.

Examples of organic diacids or diesters including vinyl diacids or vinyl diesters selected for the preparation of crystalline resins include oxalic acid, succinic acid, glutaric acid, adipic acid, suberic acid, azelaic acid, sebacic acid, fumaric acid, dimethyl fumarate, dimethyl itaconate, cis, 1,4-diacetoxy-2-butene, diethyl fumarate, diethyl maleate, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof. The organic diacid may be selected in an amount of, for example, from about 40 to about 60 mole percent of the resin, from about 42 to about 52 mole percent of the resin, or from about 45 to about 50 mole percent of the resin, and a second diacid can be selected in an amount of from about 0 to about 10 mole percent of the resin.

Polycondensation catalysts which may be utilized in forming crystalline (as well as amorphous) polyesters include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be utilized in amounts of, for example, from about 0.01 mole percent to about 5 mole percent based on the starting diacid or diester used to generate the polyester resin.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), poly(decylene-sebacate), poly(decylene-decanoate), poly(ethylene-decanoate), poly(ethylene dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), copoly(2,2-dimethylpropane-1,3-diol-decanoate)-copoly(nonylene-decanoate), poly(octylene-adipate), and mixtures thereof. Examples of polyamides include poly(ethylene-adipamide), poly(propylene-adipamide), poly(butylenes-adipamide), poly(pentylene-adipamide), poly(hexylene-adipamide), poly(octylene-adipamide), poly(ethylene-succinimide), poly(propylene-sebecamide), and mixtures thereof. Examples of polyimides include poly(ethylene-adipimide), poly(propylene-adipimide), poly(butylene-adipimide), poly(pentylene-adipimide), poly(hexylene-adipimide), poly(octylene-adipimide), poly(ethylene-succinimide), poly(propylene-succinimide), poly(butylene-succinimide), and mixtures thereof.

In embodiments, the crystalline polyester resin has the following formula (I)

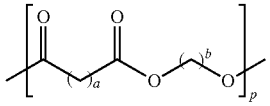

(I)

wherein each of a and b may range from 1 to 12, from 2 to 12, or from 4 to 12 and further wherein p may range from 10 to 100, from 20 to 80, or from 30 to 60. In embodiments, the crystalline polyester resin is poly(1,6-hexylene-1,12-dodecanoate), which may be generated by the reaction of dodecanedioc acid and 1,6-hexanediol.

As noted above, the disclosed crystalline polyester resins may be prepared by a polycondensation process by reacting suitable organic diols and suitable organic diacids in the presence of polycondensation catalysts. A stoichiometric equimolar ratio of organic diol and organic diacid may be utilized, however, in some instances where the boiling point of the organic diol is from about 180° C. to about 230° C., an excess amount of diol, such as ethylene glycol or propylene glycol, of from about 0.2 to 1 mole equivalent, can be utilized and removed during the polycondensation process by distillation. The amount of catalyst utilized may vary, and can be selected in amounts, such as for example, from about 0.01 to about 1 or from about 0.1 to about 0.75 mole percent of the crystalline polyester resin.

The crystalline resin may be present, for example, in an amount of from about 1% to about 85% by weight of the toner, from about 5% to about 50% by weight of the toner, or from about 10% to about 35% by weight of the toner.

The crystalline resin can possess various melting points of, for example, from about 30° C. to about 120° C., from about 50° C. to about 90° C., or from about 60° C. to about 80° C. The crystalline resin may have a number average molecular weight ($M_n$), as measured by gel permeation chromatography (GPC) of, for example, from about 1,000 to about 50,000, from about 2,000 to about 25,000, or from about 5,000 to about 20,000, and a weight average molecular weight ($M_w$) of, for example, from about 2,000 to about 100,000, from about 3,000 to about 80,000, or from about 10,000 to about 30,000, as determined by GPC. The molecular weight distribution ($M_w/M_n$) of the crystalline resin may be, for example, from about 2 to about 6, from about 3 to about 5, or from about 2 to about 4.

Amorphous Resin

The resin may be an amorphous polyester resin formed by reacting a diol with a diacid in the presence of an optional catalyst. Examples of diacids or diesters including vinyl diacids or vinyl diesters utilized for the preparation of amorphous polyesters include dicarboxylic acids or diesters such as terephthalic acid, phthalic acid, isophthalic acid, fumaric acid, trimellitic acid, dimethyl fumarate, dimethyl itaconate, cis, 1,4-diacetoxy-2-butene, diethyl fumarate, diethyl maleate, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The organic diacids or diesters may be present, for example, in an amount from about 40 to about 60 mole percent of the resin, from about 42 to about 52 mole percent of the resin, or from about 45 to about 50 mole percent of the resin.

Examples of diols which may be utilized in generating an amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis(2-hydroxyethyl) oxide, dipropylene glycol, dibutylene, and combinations thereof. The amount of organic diols selected may vary, for example, the organic diols may be present in an amount from about 40 to about 60 mole percent of the resin, from about 42 to about 55 mole percent of the resin, or from about 45 to about 53 mole percent of the resin.

Examples of suitable amorphous resins include polyesters, polyamides, polyimides, polyolefins, polyethylene, polybutylene, polyisobutyrate, ethylene-propylene copolymers, ethylene-vinyl acetate copolymers, polypropylene, and the like, and mixtures thereof.

An unsaturated amorphous polyester resin may be utilized as a resin. Examples of such resins include those disclosed in U.S. Pat. No. 6,063,827, the disclosure of which is hereby incorporated by reference in its entirety. Exemplary unsaturated amorphous polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof.

A suitable polyester resin may be an amorphous polyester such as a poly(propoxylated bisphenol A co-fumarate) resin. Examples of such resins and processes for their production include those disclosed in U.S. Pat. No. 6,063,827, the disclosure of which is hereby incorporated by reference in its entirety.

Suitable polyester resins include amorphous acidic polyester resins. An amorphous acid polyester resin may be based on any combination of propoxylated bisphenol A, ethoxylated bisphenol A, terephthalic acid, fumaric acid, and dodecenyl succinic anhydride, such as poly(propoxylated bisphenol-co-terephthlate-fumarate-dodecenylsuccinate). Another amorphous acid polyester resin which may be used is poly(propoxylated-ethoxylated bisphenol-co-terephthalate-dodecenylsuccinate-trimellitic anhydride).

An example of a linear propoxylated bisphenol A fumarate resin which may be utilized as a resin is available under the trade name SPAMII from Resana S/A Industrias Quimicas, Sao Paulo Brazil. Other propoxylated bisphenol A fumarate resins that may be utilized and are commercially available include GTUF and FPESL-2 from Kao Corporation, Japan, and EM181635 from Reichhold, Research Triangle Park, N.C., and the like.

An amorphous resin or combination of amorphous resins may be present, for example, in an amount of from about 5% to about 95% by weight of the toner, from about 30% to about 90% by weight of the toner, or from about 35% to about 85% by weight of the toner.

The amorphous resin or combination of amorphous resins may have a glass transition temperature of from about 30° C. to about 80° C., from about 35° C. to about 70° C., or from about 40° C. to about 65° C. The glass transition temperature may be measured using differential scanning calorimetry (DSC). The amorphous resin may have a $M_n$, as measured by GPC of, for example, from about 1,000 to about 50,000, from about 2,000 to about 25,000, or from about 1,000 to about 10,000, and a $M_w$ of, for example, from about 2,000 to about 100,000, from about 5,000 to about 90,000, from about 10,000 to about 90,000, from about 10,000 to about 30,000, or from about 70,000 to about 100,000, as determined by GPC.

One, two, or more resins may be used. Where two or more resins are used, the resins may be in any suitable ratio (e.g., weight ratio) such as for instance of from about 1% (first resin)/99% (second resin) to about 99% (first resin)/1% (second resin), from about 10% (first resin)/90% (second resin) to about 90% (first resin)/10% (second resin). Where the resins include a combination of amorphous and crystalline resins, the resins may be in a weight ratio of, for example, from about 1% (crystalline resin)/99% (amorphous resin) to about 99% (crystalline resin)/1% (amorphous resin), or from about 10% (crystalline resin)/90% (amorphous resin) to about 90% (crystalline resin)/10% (amorphous resin). In some embodiments, the weight ratio of the resins is from about 80% to about 60% of the amorphous resin and from about 20% to about 40% of the crystalline resin. In such embodiments, the amorphous resin may be a combination of amorphous resins, e.g., a combination of two amorphous resins.

The resin(s) in the present toners may possess acid groups which may be present at the terminal of the resin. Acid groups which may be present include carboxylic acid groups, and the like. The number of carboxylic acid groups may be controlled by adjusting the materials utilized to form the resin and reaction conditions. In embodiments, the resin is a polyester resin having an acid number from about 2 mg KOH/g of resin to about 200 mg KOH/g of resin, from about 5 mg KOH/g of resin to about 50 mg KOH/g of resin, or from about 5 mg KOH/g of resin to about 15 mg KOH/g of resin. The acid containing resin may be dissolved in tetrahydrofuran solution. The acid number may be detected by titration with KOH/methanol solution containing phenolphthalein as the indicator. The acid number may then be calculated based on the equivalent amount of KOH/methanol required to neutralize all the acid groups on the resin identified as the end point of the titration.

In embodiments, the resin of the toner is not an optically transparent resin, e.g., a polycarbonate resin, a polyethylene terephthalate resin, a polymethyl methacrylate resin, a polythiophene resin, or a polyaniline resin. In such embodiments, the toner does not comprise any of these resins. In embodiments, the resin of the toner is not a crosslinked resin and the toner does not comprise such a resin. In such embodiments, the components of the toner have not been crosslinked by reactions initiated by heat, pressure, change in pH, exposure to radiation, etc. In embodiments, the resin of the toner is not a sulfonated polyester resin comprising a metal ion, e.g., a silver or gold metal ion. In such embodiments, the toner does not comprise such a resin. In embodiments, the toner does not comprise metal ion nanoparticles such as a silver or gold metal ion nanoparticle. In each of these embodiments, being free of a particular resin, being free of crosslinks, or being free of metal ion nanoparticles means the complete absence of these features or that these features are present at such a small amount so as to have no material effect on the properties of the toner (described further below).

Toner

In order to form the present toners, any of the resins described above may provided as an emulsion(s), e.g., by using a solvent-based phase inversion emulsification process. The emulsions may then be utilized as the raw materials to form the toners, e.g., by using an emulsion aggregation and coalescence (EA) process.

To form the present toners, the graphene may be provided as a dispersion in a solvent or a solution, e.g., an aqueous surfactant solution. The surfactant may be selected to facilitate homogeneous dispersion of the graphene within the solution. Illustrative surfactants include anionic surfactants such as, diphenyl oxide disulfonate, ammonium lauryl sulfate, sodium dodecyl benzene sulfonate, dodecyl benzene sulfonic acid, sodium alkyl naphthalene sulfonate, sodium dialkyl sulfosuccinate, sodium alkyl diphenyl ether disulfonate, potassium salt of alkylphosphate, sodium polyoxyethylene lauryl ether sulfate, sodium polyoxyethylene alkyl ether sulfate, sodium polyoxyethylene alkyl ether sulfate, triethanolamine polyoxyethylene alkylether sulfate, sodium naphthalene sulfate, and sodium naphthalene sulfonate formaldehyde condensate, and mixtures thereof; and nonionic surfactants such as, polyvinyl alcohol, methyl cellulose, ethyl cellulose, propyl cellulose, hydroxy ethyl cellulose, carboxy methylcellulose, polyoxyethylene cetyl ether, polyoxyethylene lauryl ether, polyoxyethylene octyl ether, polyoxyethylene nonylphenyl ether, polyoxyethylene oleyl ether, polyoxyethylene sorbitan monolaurate, polyoxyethylene stearyl ether, dialkylphenoxy poly(ethyleneoxy)ethanol, and mixtures thereof.

The present toners may include other additives, e.g., wax, colorants. Like the graphene, these other additives may be added as separate dispersions in forming the toners.

Wax

Optionally, a wax may also be combined with the graphene and the resin(s) in forming toner particles. The wax may be provided in a wax dispersion, which may comprise a single type of wax or a mixture of two or more different waxes. A single wax may be added, for example, to improve particular toner properties, such as toner particle shape, presence and amount of wax on the toner particle surface, charging and/or fusing characteristics, gloss, stripping, offset properties, and the like. Alternatively, a combination of waxes can be added to provide multiple properties to the toner composition.

When included, the wax may be present in an amount of, for example, from about 1% to about 25% by weight of the toner or from about 5% to about 20% by weight of the toner particles.

When a wax is used, the wax may include any of the various waxes conventionally used in emulsion aggregation toners. Waxes that may be selected include waxes having, for example, an average molecular weight of from about 500 to about 20,000 or from about 1,000 to about 10,000. Waxes that may be used include, for example, polyolefins such as polyethylene including linear polyethylene waxes and branched polyethylene waxes, polypropylene including linear polypropylene waxes and branched polypropylene waxes, polymethylene waxes, polyethylene/amide, polyethylenetetrafluoroethylene, polyethylenetetrafluoroethylene/amide, and polybutene waxes such as commercially available from Allied Chemical and Petrolite Corporation, for example POLYWAX™ polyethylene waxes such as commercially available from Baker Petrolite, wax emulsions available from Michaelman, Inc. and the Daniels Products Company, EPOLENE N-15™ commercially available from Eastman Chemical Products, Inc., and VISCOL 550-P™, a low weight average molecular weight polypropylene available from Sanyo Kasei K. K.; plant-based waxes, such as carnauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax such as waxes derived from distillation of crude oil, silicone waxes, mercapto waxes, polyester waxes, urethane waxes; modified polyolefin waxes (such as a carboxylic acid-terminated polyethylene wax or a carboxylic acid-terminated polypropylene wax); Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethylene glycol monostearate, dipropylene glycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550™, SUPERSLIP 6530™ available from Micro Powder Inc., fluorinated waxes, for example POLY- FLUO 190™, POLYFLUO 200™, POLYSILK 19™, POLYSILK14™ available from Micro Powder Inc., mixed fluorinated, amide waxes, such as aliphatic polar amide functionalized waxes; aliphatic waxes consisting of esters of hydroxylated unsaturated fatty acids, for example MICROSPERSION 19™ also available from Micro Powder Inc., imides, esters, quaternary amines, carboxylic acids or acrylic polymer emulsion, for example JONCRYL 74™, 89™, 130™, 537™ and 538™, all available from SC Johnson Wax, and chlorinated polypropylenes and polyethylenes available from Allied Chemical and Petrolite Corporation and SC Johnson wax. Mixtures and combinations of the foregoing waxes may also be used in embodiments. Waxes may be included as, for example, fuser roll release agents. In embodiments, the waxes may be crystalline or non-crystalline.

In embodiments, the wax may be incorporated into the toner in the form of one or more aqueous dispersions of solid wax in water, where the solid wax particle size may be in the range of from about 100 to about 300 nm.

Colorants

Various known colorants may be included in the present toners. The term "colorant" refers, for example, to pigments, dyes, mixtures thereof, such as mixtures of dyes, mixtures of pigments, mixtures of dyes and pigments, and the like. The colorant may be present in the toner in an amount of, for example, from about 0.1% to about 35% by weight of the toner, from about 1% to about 20% by weight of the toner, or from about 5% to about 15% by weight of the toner.

As examples of colorants, mention may be made of carbon black like REGAL 330® (Cabot), Carbon Black 5250 and 5750 (Columbian Chemicals), Sunsperse Carbon Black LHD 9303 (Sun Chemicals); magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Generally, cyan, magenta, or yellow pigments or dyes, or mixtures thereof, are used. The pigment or pigments are generally used as water based pigment dispersions.

In general, suitable colorants may include Paliogen Violet 5100 and 5890 (BASF), Normandy Magenta RD-2400 (Paul Uhlrich), Permanent Violet VT2645 (Paul Uhlrich), Heliogen Green L8730 (BASF), Argyle Green XP-111-S (Paul Uhlrich), Brilliant Green Toner GR 0991 (Paul Uhlrich), Lithol Scarlet D3700 (BASF), Toluidine Red (Aldrich), Scarlet for Thermoplast NSD PS PA (Ugine Kuhlmann of Canada), Lithol Rubine Toner (Paul Uhlrich), Lithol Scarlet 4440 (BASF), NBD 3700 (BASF), Bon Red C (Dominion Color), Royal Brilliant Red RD-8192 (Paul Uhlrich), Oracet Pink RF (Ciba Geigy), Paliogen Red 3340 and 3871 K (BASF), Lithol Fast Scarlet L4300 (BASF), Heliogen Blue D6840, D7080, K7090, K6910 and L7020 (BASF), Sudan Blue OS (BASF), Neopen Blue FF4012 (BASF), PV Fast Blue B2G01 (American Hoechst), Irgalite Blue BCA (Ciba Geigy), Paliogen Blue 6470 (BASF), Sudan II, III and IV (Matheson, Coleman, Bell), Sudan Orange (Aldrich), Sudan Orange 220 (BASF), Paliogen Orange 3040 (BASF), Ortho Orange OR 2673 (Paul Uhlrich), Paliogen Yellow 152 and 1560 (BASF), Lithol Fast Yellow 0991 K (BASF), Paliotol Yellow 1840 (BASF), Novaperm Yellow FGL (Hoechst), Permanent Yellow YE 0305 (Paul Uhlrich), Lumogen Yellow D0790 (BASF), Sunsperse Yellow YHD 6001 (Sun Chemicals), Suco-Gelb 1250 (BASF), Suco-Yellow D1355 (BASF), Suco Fast Yellow D1165, D1355 and D1351 (BASF), Hostaperm Pink E™ (Hoechst), Fanal Pink D4830 (BASF), Cinquasia Magenta™ (DuPont), Paliogen Black L9984 (BASF), Pigment Black K801 (BASF), Levanyl Black A-SF (Miles, Bayer), combinations of the foregoing, and the like.

Other suitable water based colorant dispersions include those commercially available from Clariant, for example, Hostafine Yellow GR, Hostafine Black T and Black TS, Hostafine Blue B2G, Hostafine Rubine F6B and magenta dry pigment such as Toner Magenta 6BVP2213 and Toner Magenta EO2 which may be dispersed in water and/or surfactant prior to use.

Specific examples of pigments include Sunsperse BHD 6011X (Blue 15 Type), Sunsperse BHD 9312X (Pigment Blue 15 74160), Sunsperse BHD 6000X (Pigment Blue 15:3 74160), Sunsperse GHD 9600X and GHD 6004X (Pigment Green 7 74260), Sunsperse QHD 6040X (Pigment Red 122 73915), Sunsperse RHD 9668X (Pigment Red 185 12516), Sunsperse RHD 9365X and 9504X (Pigment Red 57 15850: 1, Sunsperse YHD 6005X (Pigment Yellow 83 21108), Flexiverse YFD 4249 (Pigment Yellow 17 21105), Sunsperse YHD 6020X and 6045X (Pigment Yellow 74 11741), Sunsperse YHD 600X and 9604X (Pigment Yellow 14 21095), Flexiverse LFD 4343 and LFD 9736 (Pigment Black 7 77226), Aquatone, combinations thereof, and the like, as water based pigment dispersions from Sun Chemicals, Heliogen Blue L6900™, D6840™, D7080™, D7020™, Pylam Oil Blue™, Pylam Oil Yellow™, Pigment Blue 1™ available from Paul Uhlrich & Company, Inc., Pigment Violet 1™, Pigment Red 48™, Lemon Chrome Yellow DCC 1026™, E.D. Toluidine Red™ and Bon Red C™ available from Dominion Color Corporation, Ltd., Toronto, Ontario, Novaperm Yellow FGL™, and the like. Generally, colorants that can be selected are black, cyan, magenta, or yellow, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, Pigment Blue 15:3, and Anthrathrene Blue, identified in the Color Index as CI 69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL.

The colorant may include a pigment, a dye, combinations thereof, carbon black, magnetite, black, cyan, magenta, yellow, red, green, blue, brown, combinations thereof, in an amount sufficient to impart the desired color to the toner. It is to be understood that other useful colorants will become readily apparent based on the present specification.

Toner Preparation

In embodiments, the present toners are prepared by EA processes, such as by a process that includes aggregating a mixture of one or more emulsions, each emulsion comprising a resin; graphene; and optionally a wax; and then coalescing the mixture. As described above, the graphene and the wax may be utilized as separate aqueous dispersions.

The mixture may be homogenized which may be accomplished by mixing at about 600 to about 6,000 revolutions per minute. Homogenization may be accomplished by any suitable means, including, for example, an IKA ULTRA TURRAX T50 probe homogenizer.

Following the preparation of the above mixture, an aggregating agent may be added to the mixture. Any suitable aggregating agent may be utilized. Suitable aggregating agents include, for example, aqueous solutions of a divalent cation or a multivalent cation material. The aggregating agent may be, for example, an inorganic cationic aggregating agent such as a polyaluminum halide such as polyaluminum chloride (PAC), or the corresponding bromide, fluoride, or iodide; a polyaluminum silicate such as polyaluminum sulfosilicate (PASS); or a water soluble metal salt including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, and copper sulfate; or combinations thereof. The aggregating agent may be added to the mixture at a temperature that is below the glass transition temperature ($T_g$) of the resin (s). The aggregating agent may be added to the mixture under homogenization.

The aggregating agent may be added to the mixture in an amount of, for example, from about 0% to about 10% by weight of the resin, from about 0.2% to about 8% by weight of the resin, or from about 0.5% to about 5% by weight of the resin.

The particles of the mixture may be permitted to aggregate until a predetermined desired particle size is obtained. A predetermined desired size refers to the desired particle size to be obtained as determined prior to formation, and the particle size being monitored during the growth process until such particle size is reached. Samples may be taken during the growth process and analyzed, for example with a Coulter Counter, for volume average particle size. The aggregation thus may proceed by maintaining an elevated temperature, or slowly raising the temperature to, for example, in embodiments, from about 30° C. to about 100° C., in embodiments from about 30° C. to about 80° C., or in embodiments from about 30° C. to about 50° C. The temperature may be held for a period time of from about 0.5 hours to about 6 hours, or in embodiments from about hour 1 to about 5 hours, while stirring, to provide the aggregated particles. Once the predetermined desired particle size is reached, a shell may be added. The volume average particle size of the particles prior to application of a shell may be, for example, from about 3 μm to about 10 μm, in embodiments, from about 4 μm to about 9 μm, or from about 6 μm to about 8 μm.

Shell Resin

After aggregation, but prior to coalescence, a resin coating may be applied to the aggregated particles to form a shell thereover. Any of the resins described above may be utilized in the shell. In embodiments, an amorphous polyester resin is utilized in the shell. In embodiments, two amorphous polyester resins are utilized in the shell, e.g., in substantially equal amounts. In embodiments, a crystalline polyester resin and two different types of amorphous polyester resins are utilized in the core and the same two types of amorphous polyester resins are utilized in the shell.

The shell may be applied to the aggregated particles by using the shell resins in the form of emulsion(s) as described above. Such emulsions may be combined with the aggregated particles under conditions sufficient to form a coating over the aggregated particles. For example, the formation of the shell over the aggregated particles may occur while heating to a temperature of from about 30° C. to about 80° C. or from about 35° C. to about 70° C. The formation of the shell may take place for a period of time from about 5 minutes to about 10 hours or from about 10 minutes to about 5 hours.

Once the desired size of the toner particles is achieved, the pH of the mixture may be adjusted with a pH control agent, e.g., a base, to a value of from about 3 to about 10, or in embodiments from about 5 to about 9. The adjustment of the pH may be utilized to freeze, that is to stop, toner growth. The base utilized to stop toner growth may include any suitable base such as, for example, alkali metal hydroxides such as, for example, sodium hydroxide, potassium hydroxide, ammonium hydroxide, combinations thereof, and the like. In embodiments, a chelating agent such as ethylene diamine tetraacetic acid (EDTA) may be added to help adjust the pH to the desired values noted above. Other chelating agents may be used.

In embodiments, the size of the core-shell toner particles (prior to coalescence) may be from about 3 μm to about 10 μm, from about 4 μm to about 10 μm, or from about 6 μm to about 9 μm.

Coalescence

Following aggregation to the desired particle size and application of the shell, the particles may then be coalesced to the desired final shape, the coalescence being achieved by, for example, heating the mixture to a temperature of from about 45° C. to about 150° C., from about 55° C. to about 99° C., or about 60° C. to about 90° C., which may be at or above the glass transition temperature of the resins utilized to form the toner particles. Heating may continue or the pH of the mixture may be adjusted (e.g., reduced) over a period of time to reach the desired circularity. The period of time may be from about 1 hours to about 5 hours or from about 2 hours to about 4 hours. Various buffers may be used during coalescence. The total time period for coalescence may be from about 1 to about 9 hours, from about 1 to about 8 hours, or from about 1 to about 5 hours. Stirring may be utilized during coalescence, for example, from about 20 rpm to about 1000 rpm or from about 30 rpm to about 800 rpm.

After aggregation and/or coalescence, the mixture may be cooled to room temperature. The cooling may be rapid or slow, as desired. A suitable cooling process may include introducing cold water to a jacket around the reactor. After cooling, the toner particles may be screened with a sieve of a desired size, filtered, washed with water, and then dried. Drying may be accomplished by any suitable process for drying including, for example, freeze-drying.

Other Additives

In embodiments, the present toners may also contain other optional additives. For example, the toners may include positive or negative charge control agents. Surface additives may also be used. Examples of surface additives include metal oxides such as titanium oxide, silicon oxide, aluminum oxides, cerium oxides, tin oxide, mixtures thereof, and the like; colloidal and amorphous silicas, such as AEROSIL®, metal salts and metal salts of fatty acids such as zinc stearate, calcium stearate, and magnesium stearate, mixtures thereof and the like; long chain alcohols such as UNILIN 700; and mixtures thereof.

Each of these surface additives may be present in an amount of from about 0.1% to about 5% by weight of the toner or from about 0.25% by weight to about 3% by weight of the toner. In embodiments, the toner may comprise, for example, from about 0.1% to about 5% of titania by weight of the toner, from about 0.1% to about 8% of silica by weight of the toner, from about 0.1% to about 5% of colloidal silica by weight of the toner, from about 0.05% to about 4% of zinc stearate by weight of the toner, and from about 0.1% to about 4% of cerium oxide by weight of the toner.

Toner Characteristics

In embodiments, the dry toner particles, exclusive of external surface additives, exhibit one or more of the following characteristics:

(1) Volume average particle size of from about 5.0 μm to about 10.0 μm, from about 6.0 μm to about 10.0 μm, or from about 7.0 μm to about 9.0 μm.

(2) Number Average Geometric Size Distribution (GSDn) and/or Volume Average Geometric Size Distribution (GSDv) of from about 1.05 to about 1.55, from about 1.10 to about 1.40, or from about 1.10 to about 1.35.

(3) Circularity of from about 0.90 to about 1.00, from about 0.92 to about 0.99, or from about 0.95 to about 0.98.

These characteristics may be measured according to the techniques described in the Example, below.

The present toners may possess excellent charging characteristics under a variety of relative humidity (RH) conditions, for example, a low-humidity zone (J-zone) of 21.1° C./10% RH and a high humidity zone (A-zone) of about 28° C./85% RH. Similarly, the present toners may possess excellent flow and blocking characteristics. In embodiments, the toner particles, exclusive of external surface additives, exhibit one or more of the following characteristics:

(4) A-zone charge to diameter ratio (Q/D) of from about −0.10 fC/μm to about 2.0 fC/μm, from about 0.11 fC/μm to about 0.19 fC/μm, or from about 0.13 fC/μm to about 0.17 fC/μm.

(5) A-zone charge per mass ratio (Q/M) of from about 1 μC/g to about 20 μC/g from about 5 μC/g to about 15 μC/g, or from about 5 μC/g to about 10 K/g.

(6) J-zone charge to diameter ratio (Q/D) of from about 0.90 fC/μm to about 2.0 fC/μm, from about 0.92 fC/μm to about 1.0 fC/μm, or from about 0.94 fC/μm to about 0.99 fC/μm.

(7) J-zone charge per mass ratio (Q/M) of from about 20 μC/g to about 60 μC/g, from about 25 μC/g to about 50 μC/g, or from about 30 μC/g to about 50 μC/g.

These characteristics may be measured according to the techniques described in the Example, below.

In embodiments, the toner particles, inclusive of external surface additives, exhibit one or more of the following characteristics:

(8) Charge maintenance in A-zone after 24 hours in the range of from about 70% to about 80%, from about 72% to about 80%, or from about 74% to about 80%.

(9) Charge maintenance in A-zone after 7 days in the range of from about 50% to about 60%, from about 52% to about 58%, or from about 53% to about 58%.

(10) Cohesion in the range of from about 5% to about 15%, of from about 6% to about 12%, or of from about 7% to about 10%.

(11) Onset of blocking temperature of greater than about 55° C., greater than about 56° C., greater than about 57° C., or in the range of from about 56° C. to about 58° C.

(12) Dielectric loss (×1000) in the range of from about 20 to about 40, from about 22 to about 38, or from about 23 to about 35.

These characteristics may be measured according to the techniques described in the Example, below, and using the surface additives described in the Example, below.

The present toners may possess excellent fusing characteristics as reflected by one or more of the following: gloss temperature to reach a gloss of 40, peak gloss, cold offset temperature, hot offset temperature, and minimum fix temperature (MFT). These characteristics may be measured according to the techniques described in the Example, below, and using the surface additives described in the Example, below. Notably, in at least some embodiments, the present toners are able to significantly suppress the MFT as compared to other conventional control toners which do not include graphene. In embodiments, the toner particles, inclusive of external surface additives, exhibit a MFT of no more than about 130° C., no more than about 128° C., no more than about 127° C., or a MFT in the range of about 120° C. to about 130° C.

In embodiments, a graphene-containing toner, inclusive of external surface additives, exhibits a MFT which is at least 5° C. lower than a MFT of a comparative toner. By "comparative toner," it is meant a toner which is prepared using the same toner ingredients and process as the toner containing graphene except that the comparative toner does not contain graphene. Instead, the comparative toner may contain a cyan pigment in place of the graphene. A suitable comparative toner is a XEROX® 700 toner as used in the Example, below. This includes embodiments in which the graphene-containing toner, inclusive of external surface additives exhibits a MFT which is at least 10° C. lower or at least 15° C. lower than the comparative toner.

Developers and Carriers

The present toners may be formulated into a developer composition. Developer compositions can be prepared by mixing the toners of the present disclosure with known carrier particles, including coated carriers, such as steel, ferrites, and the like. Such carriers include those disclosed in U.S. Pat. Nos. 4,937,166 and 4,935,326, the entire disclosures of each of which are incorporated herein by reference. The toners may be present in the carrier in amounts of from about 1% to about 15% by weight, from about 2% to about 8% by weight, or from about 4% to about 6% by weight. The carrier particles can also include a core with a polymer coating thereover, such as polymethylmethacrylate (PMMA), having dispersed therein a conductive component like conductive carbon black. Carrier coatings include silicone resins such as methyl silsesquioxanes, fluoropolymers such as polyvinylidiene fluoride, mixtures of resins not in close proximity in the triboelectric series such as polyvinylidiene fluoride and acrylics, thermosetting resins such as acrylics, mixtures thereof and other known components.

Applications

The present toners may be used in a variety of xerographic processes and with a variety of xerographic printers. A xerographic imaging process includes, for example, preparing an image with a xerographic printer comprising a charging component, an imaging component, a photoconductive component, a developing component, a transfer component, and a fusing component. In embodiments, the development component may include a developer prepared by mixing a carrier with any of the toners described herein. The xerographic printer may be a high speed printer, a black and white high speed printer, a color printer, and the like. Once the image is formed with the toners/developers, the image may then be transferred to an image receiving medium such as paper and the like. Fuser roll members may be used to fuse the toner to the image-receiving medium by using heat and pressure. Use of the present toners with a xerographic printing process can provide conductive printed images as well as metallic color printed images.

The present toners find use in other applications such as powder coating applications in which a powder spray gun (e.g., a tribo gun) containing any of the present toners is used to deliver the toner to a substrate.

EXAMPLE

The following Example is being submitted to illustrate various embodiments of the present disclosure. The Example is intended to be illustrative only and is not intended to limit the scope of the present disclosure. Also, parts and percentages are by weight unless otherwise indicated. As used throughout this patent specification, "room temperature" refers to a temperature of from about 20° C. to about 25° C.

Graphene Toner Preparation.

Graphene-containing toners were prepared as follows. The graphene used were graphene nanoplatelets obtained from Strem Chemical Inc. Throughout this Example, "graphene" refers to these graphene nanoplatelets. The graphene was dispersed by sonication into an aqueous surfactant solution. The surfactant was branched sodium diphenyl oxide disulfonate (Calfax DB-45 from Pilot Chemical Company). A 3.0 pph surfactant to graphene ratio was used. The graphene dispersion was mixed with an emulsion containing one type of amorphous polyester resin, another emulsion containing another type of amorphous polyester resin, another emulsion containing a crystalline polyester resin, and a wax dispersion. After acidifying the mixture, aluminum sulfate (ALS) solution was added slowly while homogenizing. The highly viscous mixture was transferred to a 2 L reactor and the aggregation initiated by increasing the temperature to about 45° C. When the particle size reached about 7.0 μm, emulsions including the two amorphous polyester resins were added to form a shell over the particles and the particles were allowed to continue grow to about 8.0 μm. The particles were frozen by adding EDTA and base. The reactor temperature was increased and coalescence started at about 84° C. The heating was stopped when the particle circularity reached 0.974±0.002. The particle slurry was quenched by lowering the temperature to below 40° C., then screened with a 20 μm sieve, and then filtered under vacuum. The resulting toner particles were washed with deionized water and freeze-dried. Using this procedure, three toner compositions having different amounts of graphene loading were prepared, including 0.5% by weight graphene, 1% by weight graphene, and 2% by weight graphene (based on the total weight of the toner). The control toner used (comparative toner) was a XEROX® 700 control toner. This control toner has the same composition and is made by the same process as the graphene-containing toners except that the control toner includes a cyan pigment at 5.5% by weight of the control toner in place of graphene.

Toner Characterization.

Toner particle size was analyzed from dry toner particles, exclusive of external surface additives, using a Beckman Coulter Multisizer 3 operated in accordance with the manufacturer's instructions. Representative sampling occurred as follows: a small amount of toner sample, about 1 gram, was be obtained and filtered through a 25 μm screen, then put in isotonic solution to obtain a concentration of about 10%, with the sample then run in the multisizer. The volume average particle size for the three graphene-containing toners was in the range of from about 7.5 μm to about 8.0 μm. For the 0.5% by weight graphene toner, the GSDn was about 1.215 and the GSDv was about 1.19.

Circularity was analyzed from dry toner particles, exclusive of external surface additives, using a Sysmex 3000 operated in accordance with the manufacturer's instructions. Circularity for the three graphene-containing toners was in the range of about 0.974 to about 0.976.

Toner particle morphology was analyzed from dry toner particles, exclusive of external surface additives, by transmission electron microscopy (TEM) and scanning electron microscopy (SEM). A SEM image of the 1% by weight graphene toner is shown in FIG. 1. The SEM image shows high quality toner particles having potato-shape morphology. The TEM images (data not shown) clearly showed the core-shell structure with complete graphene encapsulation (no graphene is present at or on the surface of the particles or within the shell).

Toner Additive Blending.

Samples were prepared by adding about 50 g of the toner an SKM mill along with an additive package including silica, titania and zinc stearate and then blended for about 30 seconds at approximately 12500 rpm. Surface additives were 1.29% RY50L silica, 0.86% RX50 silica, 0.88% STT100H titania, 1.73% X24 sol-gel colloidal silica, and 0.18% zinc stearate, 0.5% PMMA and 0.28% cerium oxide particles, based on the total weight of the toner.

Toner Charging.

Toner charging was collected for both the parent toner particle (without any surface additives) and for the blended toner particle (with surface additives). For parent toner particles, 8 pph of toner in carrier was prepared utilizing 1.5 grams of toner and 30 grams of XEROX® 700 carrier in a 60 mL glass bottle. For the blended toner, 5 pph of toner in carrier was prepared utilizing 1.8 grams of toner and 30 grams of XEROX® 700 carrier in a 60 mL glass bottle. Samples were conditioned three days in a low-humidity zone (J zone) at 21.1° C./10% relative humidity, and in a separate sample in a high humidity zone (A zone) at about 28° C./85% relative humidity. The developers with parent toner particles were charged in a Turbula mixer for 10 minutes, the developers with additive blended toner were charged in a Turbula mixer for 60 minutes.

The toner charge was measured in the form of Q/D, the charge to diameter ratio. The Q/D was measured using a charge spectrograph having a 100 V/cm field, and was measured visually as the midpoint of the toner charge distribution. The charge was reported in millimeters of displacement from the zero line (mm displacement can be converted to femtocoulombs/micron (fC/μm) by multiplying by 0.092).

The toner charge was also measured as the charge per mass ratio (Q/M) as determined by the total blow-off charge method, measuring the charge on a faraday cage containing the developer after removing the toner by blow-off in a stream of air. The total charge collected in the cage is divided by the mass of toner removed by the blow-off, by weighing the cage before and after blow-off to give the Q/M ratio.

Toner Charge Maintenance.

A developer sample was prepared by weighing 1.8 g of additive blended toner onto 30 g of carrier in a washed 60 ml glass bottle. The developer was conditioned in an A-zone environment of 28° C./85% RH for three days to equilibrate fully. The developer was charged by agitating the sample for two minutes in a Turbula mixer. The charge per unit mass of the sample was measured using a tribo charge blow-off method as described above. The sample was then returned to the A-zone chamber in an idle position. The charge per unit mass measurement was repeated again after 24 hours and 7 days. Charge maintenance was calculated from the 24 h and 7 day charge as a percentage of the initial charge.

Toner Blocking.

Toner blocking was determined by measuring the toner cohesion at an elevated temperature above room temperature. The toner blocking measurement was completed as follows: two grams of additive blended toner was weighed into an open dish and conditioned in an environmental chamber at the specified elevated temperature and 50% relative humidity. After about 17 hours the samples were removed and acclimated in ambient conditions for about 30 minutes. Each re-acclimated sample was measured by sieving through a stack of two pre-weighed mesh sieves, which were stacked as follows: 1000 μm on top and 106 μm on bottom. The sieves are vibrated for about 90 seconds at about 1 mm amplitude with a Hosokawa flow tester. After the vibration was completed the sieves are reweighed and toner blocking is calculated from the total amount of toner remaining on both sieves as a percentage of the starting weight. Thus, for a 2 gram toner sample, if A is the weight of toner left on the top 1000 μm screen and B is the weight of toner left on the bottom 106 μm screen, the toner blocking percentage is calculated by: % blocking=50 (A+B). The onset blocking temperature was also determined, which is defined as the temperature at which the measured toner cohesion begins to rapidly increase with temperature.

Dielectric Loss.

Also measured was dielectric loss in a custom-made fixture connected to an HP4263B LCR Meter via shielded 1 meter BNC cables. To ensure reproducibility and consistency, one gram of toner (conditioned in C-zone 24 h) was placed in a mold having a 2-inch diameter and pressed by a precision-ground plunger at about 2000 psi for 2 minutes. While maintaining contact with the plunger (which acted as one electrode), the pellet was then forced out of the mold onto a spring-loaded support, which kept the pellet under pressure and also acted as the counter-electrode. The current set-up eliminated the need for using additional contact materials (such as tin foils or grease) and also enabled the in situ measurement of pellet thickness. Dielectric constant and dielectric loss were determined by measuring the capacitance (Cp) and the loss factor (D) at 100 kHz frequency and 1 VAC. The measurements were carried out under ambient conditions. The dielectric constant was calculated as follows:

$$E'=[Cp(\text{pF})\times\text{Thickness}(\text{mm})]/[8.854\times A_{effective}(\text{m}^2)]$$

The constant "8.854" in the formula above is the vacuum electrical permittivity $\varepsilon_o$ in units that takes into account the fact that Cp is in picofarads (not farads), and thickness is in mm (not meters). $A_{effective}$ is the effective area of the sample. Dielectric loss=E*Dissipation factor, which measures the electrical dissipation of the sample (i.e., how leaky a capacitor it was). For simplification purpose in the present specification, the value E' is multiplied by 1000. Accordingly, a reported dielectric loss value of 70 indicated a dielectric loss of $70\times10^{-3}$, or 0.070.

Toner properties are summarized in Tables 1-3, below.

TABLE 2

Additive charging results for control toner and graphene (Gn)-containing toners.

| | | 60 min Additive Charging, 5 pph TC | | | | | |
|---|---|---|---|---|---|---|---|
| | | A-zone | | J-zone | | RH ratio | |
| Sample | Composition | Q/D (mm) | Q/M (μC/g) | Q/D (mm) | Q/D (mm) | Q/M (μC/g) | add RH Q/m |
| Control | Cyan | 5.5 | 29 | 11.0 | 62 | 0.50 | 0.47 |
| Sample 1 | 0.5% Gn | 3.4 | 15 | 11.9 | 42 | 0.29 | 0.36 |
| Sample 2 | 1% Gn | 3.6 | 16 | 12.6 | 43 | 0.28 | 0.37 |
| Sample 3 | 2% Gn | 3.5 | 16 | 13.1 | 39 | 0.27 | 0.41 |

TABLE 1

Parent charging results for control toner and graphene (Gn)-containing toners.

| | | 10 min Parent Charging, 8 pph TC | | | | | |
|---|---|---|---|---|---|---|---|
| | | A-zone | | J-zone | | RH ratio | |
| Sample | Composition | Q/D (mm) | Q/M (μC/g) | Q/D (mm) | Q/M (μC/g) | RH Q/D | RH Q/M |
| Control | Cyan | 3.9 | 15 | 15.0 | 67 | 0.26 | 0.22 |
| Sample 1 | 0.5% Gn | 1.7 | 8 | 10.7 | 45 | 0.16 | 0.18 |
| Sample 2 | 1% Gn | 1.5 | 8 | 10.8 | 40 | 0.14 | 0.20 |
| Sample 3 | 2% Gn | 1.6 | 8 | 10.4 | 33 | 0.15 | 0.24 |

TABLE 3

Other results for control toner and graphene (Gn)-containing toners.

| | | Charge Maintenance (%) | | Blocking Onset Temp | Cohesion | Dielectric Loss |
|---|---|---|---|---|---|---|
| Sample | Composition | 24 h | 7 d | (° C.) | (%) | (×1000) |
| Control | Cyan | 73 | 51 | 54.4 | 23 | 21 |
| Sample 1 | 0.5% Gn | 79 | 58 | 57.4 | 8 | 24 |
| Sample 2 | 1% Gn | 77 | 58 | 57.2 | 9 | 28 |
| Sample 3 | 2% Gn | 76 | 56 | 57.2 | 9 | 31 |

The results of Tables 1-3 may be summarized as follows. The J-zone parent charge and additive-blended charge (Q/D and Q/M) decreased slightly upon adding graphene at 0.5% loading. However, adding additional graphene did not have a significant affect. The A-zone parent Q/D and additive-blended Q/D decreased slightly upon adding graphene at 0.5% loading. However, adding additional graphene did not have a significant affect. The A-zone parent Q/M and additive-blended Q/D was not significantly affected. Overall, the charge characteristics of the graphene-containing toners is not significantly affected as compared to the control toner. The charge maintenance was the same or improved at both 24 hours and 7 days for the graphene-containing toners as compared to the control toner. The blocking performance and toner flow was excellent for the graphene-containing toners and not affected by the addition of graphene. Dielectric loss increased with graphene loading, but well within the functional limits of the control toner (which typically has a dielectric loss of 30 to 35).

Toner Fusing.

Fusing characteristics of the toners were determined by crease area, minimum fixing temperature, and gloss. All unfused images were generated using a modified Xerox copier. A TMA (Toner Mass per unit Area) of 1.00 mg/cm$^2$ was used for the amount of toner placed onto CXS paper (Color Xpressions Select, 90 gsm, uncoated, P/N 3R11540) and used for gloss, crease and hot offset measurements. Gloss/crease targets were a square image placed in the center of the page.

Samples were then fused with an oil-less fusing fixture, consisting of a Xerox® 700 production fuser CRU that was fitted with an external motor and temperature control along with paper transports. Process speed of the fuser was set to 220 mm/s (nip dwell of ~34 ms) and the fuser roll temperature was varied from cold offset to hot offset or up to 210° C. for gloss and crease measurements on the samples. After the set point temperature of the fuser roll has been changed, ten minutes are allowed to pass for the temperature of the belt and pressure assembly to stabilize.

Cold offset is the temperature at which toner sticks to the fuser, but is not yet fusing to the paper. Above the cold offset temperature the toner does not offset to the fuser until it reaches the hot offset temperature.

Crease Area.

The toner image displays mechanical properties such as crease, as determined by creasing a section of the substrate such as paper with a toned image thereon and quantifying the degree to which the toner in the crease separates from the paper. A good crease resistance may be considered a value of less than 1 mm, where the average width of the creased image is measured by printing an image on paper, followed by (a) folding inwards the printed area of the image, (b) passing over the folded image a standard TEFLON coated copper roll weighing about 860 grams, (c) unfolding the paper and wiping the loose ink from the creased imaged surface with a cotton swab, and (d) measuring the average width of the ink free creased area with an image analyzer. The crease value can also be reported in terms of area, especially when the image is sufficiently hard to break unevenly on creasing; measured in terms of area, crease values of 100 correspond to about 1 mm in width.

Minimum Fixing Temperature.

The Minimum Fixing Temperature (MFT) measurement involves folding an image on paper fused at a specific temperature, and rolling a standard weight across the fold. The print can also be folded using a commercially available folder such as the Duplo D-590 paper folder. The folded image is then unfolded and analyzed under the microscope and assessed a numerical grade based on the amount of crease showing in the fold. This procedure is repeated at various temperatures until the minimum fusing temperature (showing very little crease) is obtained.

Gloss.

Print gloss (Gardner gloss units or "ggu") was measured using a 75° BYK Gardner gloss meter for toner images that had been fused at a fuser roll temperature range of about 120° C. to about 210° C.

Hot Offset.

The hot offset temperature (HOT) is that temperature that toner that has contaminated the fuser roll is seen to transfer back onto paper. To observe it a blank piece of paper, a chase sheet, is sent through the fuser right after the print with the fused image. If an image offset is notice on the blank chase sheet at a certain fuser temperature then this is the hot offset temperature.

Toner fusing properties are summarized in Table 4, below.

TABLE 4

Fusing results for control toner and graphene (Gn)-containing toners.

| Sample | Gloss Temp T(G40) (° C.) | Peak Gloss ($G_{max}$) | Cold offset (° C.) | Hot offset (° C.) | Crease MFT T($C_{80}$) (° C.) |
|---|---|---|---|---|---|
| Control | 149 | 60.9 | 134 | 221 | 137 |
| Sample 1 (0.5% Gn) | 139 | 57.4 | 121 | 191 | 125 |
| Sample 2 (1% Gn) | 139 | 60.7 | 121 | 196 | 125 |
| Sample 3 (2% Gn) | 139 | 57.3 | 124 | 196 | 127 |

The results of Table 4 may be summarized as follows. As graphene loading increased, the gloss temperature to reach gloss 40 and peak gloss were both unaffected, even at the highest graphene content. The cold offset temperature was affected slightly with graphene loading, but in all cases the COT temperature was very low, below the crease MFT so this is not a concern. Crease MFT for all graphene-containing toners was very low and unaffected by increased graphene loading. Compared to the control, all samples had a lower gloss temperature to reach glass 40 and lower crease MFT.

It will be appreciated that variants of the above-disclosed and other features and functions or alternatives thereof, may be combined into many other different systems or applications. Various presently unforeseen or unanticipated alternatives, modifications, variations or improvements therein may be subsequently made by those skilled in the art, which are also intended to be encompassed by the following claims.

What is claimed is:

1. A graphene-containing toner comprising a core comprising graphene, a crystalline polyester resin, and an amorphous polyester resin, the toner further comprising a shell over the core.

2. The toner of claim 1, wherein the graphene is homogeneously distributed within the core and completely encapsulated within the toner.

3. The toner of claim 1, wherein the graphene is present in the toner at an amount of no more than about 10% by weight.

4. The toner of claim 1, wherein the graphene is in the form of graphene nanoplatelets.

5. The toner of claim 4, wherein the graphene nanoplatelets are characterized by an average thickness in the range of from about 6 nm to about 8 nm and an average diameter in the range of from about 0.5 μm to about 5 μm.

6. The toner of claim 1, wherein the amorphous polyester resin is a first amorphous polyester resin and the core further comprises a second amorphous polyester resin.

7. The toner of claim 6, wherein the crystalline polyester resin has Formula I Formula I

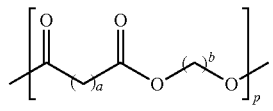

wherein each of a and b is in the range of from 1 to 12 and p is in the range of from 10 to 100.

8. The toner of claim 7, wherein the crystalline polyester resin is a poly(1,6-hexylene-1,12-dodecanoate).

9. The toner of claim 7, wherein the first amorphous polyester resin is a poly(propoxylated bisphenol-co-terephthlate-fumarate-dodecenylsuccinate) and the second amorphous polyester resin is a poly(propoxylated-ethoxylated bisphenol-co-terephthalate-dodecenylsuccinate-trimellitic anhydride).

10. The toner of claim 6, wherein the shell comprises the first amorphous polyester resin, the second amorphous polyester resin, or both.

11. The toner of claim 10, wherein the crystalline polyester resin has Formula I Formula I

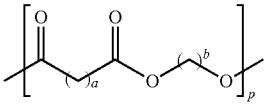

wherein each of a and b is in the range of from 1 to 12 and p is in the range of from 10 to 100.

12. The toner of claim 11, wherein the crystalline polyester resin is a poly(1,6-hexylene-1,12-dodecanoate).

13. The toner of claim 11, wherein the shell comprises both the first and second amorphous polyester resins and the first amorphous polyester resin is a poly(propoxylated bisphenol-co-terephthlate-fumarate-dodecenylsuccinate) and the second amorphous polyester resin is a poly(propoxylated-ethoxylated bisphenol-co-terephthalate-dodecenylsuccinate-trimellitic anhydride).

14. The toner of claim 1, further comprising a wax.

15. The toner of claim 1, wherein the toner is free of a colorant.

16. The toner of claim 1, wherein the toner, inclusive of external surface additives, exhibits a minimum fusing temperature which is at least 10° C. lower than a comparative toner which is the same as the toner except that the comparative toner does not comprise graphene.

17. The toner of claim 1, wherein the toner, inclusive of external surface additives, exhibits a minimum fusing temperature of no more than about 130° C.

18. A graphene-containing toner comprising a core comprising graphene nanoplatelets, a crystalline polyester resin, and an amorphous polyester resin, the toner further comprising a shell over the core, wherein the graphene nanoplatelets are homogeneously distributed within the core and completely encapsulated within the toner, and further wherein the graphene is present in the toner at an amount of no more than about 10% by weight.

19. A method of making the graphene-containing toner of claim 1, the method comprising:

forming a mixture comprising a graphene dispersion, a first emulsion comprising the crystalline polyester resin, a second emulsion comprising the amorphous polyester resin, and optionally, a wax dispersion;

aggregating the mixture to form particles of a predetermined size;

forming the shell over the particles of the predetermined size to form core-shell particles; and coalescing the core-shell particles to form the graphene-containing toner.

20. A method of using the graphene-containing toner of claim 1, the method comprising:

forming an image comprising the graphene-containing toner using a xerographic printer;

transferring the image comprising the graphene-containing toner to an image receiving medium; and fusing the graphene-containing toner to the image receiving medium.

* * * * *